US009822478B2

(12) United States Patent
Kim

(10) Patent No.: US 9,822,478 B2
(45) Date of Patent: Nov. 21, 2017

(54) WALL-MOUNTED WASHING MACHINE AND DISPENSER THEREOF

(71) Applicant: Dongbu Daewoo Electronics Corporation, Seoul (KR)

(72) Inventor: Man Ki Kim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 434 days.

(21) Appl. No.: 14/189,804

(22) Filed: Feb. 25, 2014

(65) Prior Publication Data

US 2015/0176185 A1 Jun. 25, 2015

(30) Foreign Application Priority Data

Dec. 24, 2013 (KR) ..... 10-2013-0162318

(51) Int. Cl.
*D06F 39/02* (2006.01)
*D06F 37/26* (2006.01)
*D06F 39/12* (2006.01)

(52) U.S. Cl.
CPC ..... *D06F 39/02* (2013.01); *D06F 37/267* (2013.01); *D06F 39/12* (2013.01)

(58) Field of Classification Search
CPC ..... D06F 37/267
See application file for complete search history.

(56) References Cited

FOREIGN PATENT DOCUMENTS

| | | | |
|---|---|---|---|
| EP | 0234083 | A2 | 3/2009 |
| EP | 2557220 | A2 | 2/2013 |
| GB | 2048962 | A | 12/1980 |
| KR | 10-2010-0064024 | | 6/2010 |
| KR | 10-2013-0064627 | | 6/2013 |
| KR | 10-2013-0112642 | | 10/2013 |
| KR | 20130112672 | A | 10/2013 |

OTHER PUBLICATIONS

KR 10-2013-0112672, Oct. 2013, Ju-dong Lee, English machine translation.*
The extended European Search Report dated May 21, 2015, issued in corresponding European Patent Application No. 14177103.0.
Korean Patent Abstracts, Publication No. 10-2013-0064627, Published Jun. 18, 2013, KIPO, Republic of Korea.

* cited by examiner

*Primary Examiner* — Jason Ko

(57) ABSTRACT

The present disclosure relates to a washing machine including: a tub main body which holds water, a tub cover which coupled to the tub main body which covers the front of the tub main body, a front panel on a surface of the front of the tub cover configured to cover the tub cover, a detergent container, dispenser, or case detachably coupled to the tub cover which extends through the front panel and the tub main body tub cover, and a first seal positioned between the detergent container, dispenser, or case and the tub cover configured to seal the tub main body. According to embodiments of the present disclosure, the tub main body may be more perfectly sealed by the first seal, thereby preventing water from leaking.

6 Claims, 4 Drawing Sheets

WALL-MOUNTED WASHING MACHINE AND DISPENSER THEREOF

CROSS-REFERENCE TO RELATED APPLICATIONS

This application is based on and claims priority from Korean Patent Application No. 10-2013-0162318, filed on Dec. 24, 2013 with the Korean Intellectual Property Office, the disclosure of which is incorporated herein in its entirety by reference.

TECHNICAL FIELD

The present disclosure relates to a washing machine capable of coupling with and sealing a detergent dispenser, container, or case that holds and dispenses detergent.

BACKGROUND

In general, a washing machine is a machine that washes clothes using electric power and has a tub that stores water, a rotatable drum inside the tub, and a drive unit (e.g., motor) that causes the drum to rotate. The washing machine has a water supply pipe for supplying water to the tub. One side or end of the water supply pipe is connected to an external water supply source, and the water supply pipe supplies water from the water supply source to the tub. The washing machine performs a series of washing processes using rotational motion of the drum, such as washing, rinsing, and spin-drying laundry.

Recently, a washing machine has been developed that may be installed in a small or narrow space and may be mounted on a wall. The background art of the washing machine is disclosed in Korean Patent Application No. 2013-0064627 (Jun. 18, 2013).

FIG. 1 is a cross-sectional view illustrating part of a washing machine according to the related art.

Referring to FIG. 1, according to the related art, the washing machine 10 has a tub main body 20 that stores water, a front tub 30 that covers a front side of the tub main body 20, a front panel 40 at a front side of the front tub 30, and a detergent case 50 which stores and dispenses detergent.

According to the related art, washing machine 10 has a detergent case 50 coupled to the front panel 40. To couple the detergent case 50 with the front panel 40, a protrusion 41 is on an outer surface of front panel 40, and a groove or slot 51 is in the detergent case 50. The protrusion 41 of the front panel 40 may be inserted into the groove of the detergent case 50 such that the detergent case 50 and the front panel 40 couple with each other. When the detergent case 50 is coupled to the front panel 40, the detergent case 50 may dispense detergent into the tub main body 20.

Because water is stored in the tub main body 20, the tub main body 20 may be sealed to prevent leaking. According to the related art, a sealing member 60 may be between the front tub 30 and the front panel 40 to seal the tub main body 20.

A protruding portion 31 of the front tub 30 protrudes toward the front panel 40, and the sealing member 60 is coupled to or in contact with a side surface of the protruding portion 31. The detergent case 50 may be inserted into an opening in the protruding portion 31. The protruding portion 31 may have a cylindrical shape. The sealing member 60 may also have a cylindrical shape.

According to the related art washing machine 10, the sealing member 60 is coupled to an outer surface of the protruding portion 31 to seal the tub main body 20. However, since both the protruding portion 31 and the sealing member 60 may have a cylindrical shape, curved surfaces of the protruding portion 31 and the sealing member 60 come into contact with each other. As a result, the curvature of an outer surface of the protruding portion 31 should closely match the curvature of an inner surface of the sealing member 60 in order to seal the tub main body 20. When the sealing member 60 and the front tub 30 do not come into close contact with each other, the tub main body 20 may not be sealed. As a result, the water in the tub main body 20 may leak out of the tub main body 20, and the washing machine may need to be scrapped or repaired.

According to the related art washing machine 10, the detergent case 50 is coupled to the front panel 40. The detergent case 50 extends into the tub main body 20 and must protrude out of the tub main body 20 when the detergent case 50 is coupled to the front panel 40 So that the washing machine may be installed in a small or narrow space or on a wall, there is a desire to miniaturize or reduce a size and/or depth of the washing machine.

SUMMARY

The present disclosure has been made in an effort to provide a washing machine having a more perfectly sealed tub main body and suitable for miniaturization or size and/or depth reduction.

In order to address the aforementioned issues, the present disclosure includes the following configurations and/or embodiments.

One or more exemplary embodiments of the present disclosure provide a washing machine having a tub main body that holds water, a tub cover that is coupled to the tub main body and configured to cover a front of the tub main body, a front panel on a surface of the tub cover, a detachable detergent container, dispenser, or case that extends through the front panel and the front tub, into the tub main body, and is detachably coupled to the front tub, and a first seal between the detergent container, dispenser, or case and the front tub, configured to seal the tub main body.

The detergent container, dispenser, or case may have a detergent holder (e.g., a cup), a handle connected to the detergent holderer and facing toward a front of the washing machine, and a first extension, tab, protrusion or flange that extends outward radially and fixes or secures the handle to the tub cover. Further embodiments may have one or more second extensions, tabs or protrusions similar to the first extension, tab, protrusion or flange that helps to fix or secure the handle to the tub cover.

The tub cover may include a fixing projection behind the first extension, or between the first extension or flange and the second protrusion.

The first seal may be coupled to the first extension or flange between the first extension or flange and the fixing projection.

The first seal may contact a surface of the fixing projection.

The washing machine may further include a second seal between the front panel and the tub cover to seal the tub main body.

The front panel may include a sealing projection that extends toward the tub main body, and the second seal may include a sealing groove or slot into which the sealing projection is inserted.

Other exemplary embodiments of the present disclosure provide a washing machine including a tub main body that holds water, a tub cover on side the tub main body, configured to cover a front of the tub main body, and a detachable detergent container, dispenser, or case coupled to the tub cover.

Yet other exemplary embodiments of the present disclosure provide a washing machine including a tub main body that holds water, a detergent holder that holds detergent and extends to the tub main body, a handle coupled to the detergent holding portion that faces toward a front of the washing machine, a first extension or flange that extends outward radially from the handle to fix the handle to the tub main body, a tub cover that includes a fixing projection coupled to the tub main body, and a first seal coupled to the first extension or flange and configured to seal the tub main body. According to other embodiments, the washing machine further includes a second extension or flange, and the fixing projection may be between the first extension or flange and the second extension or flange.

Still further exemplary embodiments of the present disclosure provide a washing machine including a tub main body that holds water, a tub cover coupled to the tub main body and configured to cover a front of the tub main body, a front panel on the tub cover configured to cover the tub cover, and a detergent container, dispenser, or case that extends through the front panel and the tub cover, and into the tub main body, the detergent container, dispenser, or case including a first extension or flange that couples the detergent container, dispenser, or case to the tub main body, and tub cover fixing projection on the tub cover. According to other embodiments, the washing machine further includes a second extension or flange that couples the detergent container, dispenser, or case to the tub cover, and the tub cover fixing projection may be between the first extension or flange and the second extension or flange.

The washing machine may further include a first seal coupled to the first extension or flange and configured to seal the tub main body and contact a front surface of the fixing projection.

The washing machine may further include a second seal between the front panel and the fixing projection, to seal the tub main body.

According to the present disclosure, the following effects may be achieved.

The present disclosure may more perfectly seal the tub main body using the first seal, which has a flat surface that maintains close contact with the tub main body, thereby preventing water from leaking. The present disclsoure also avoids the risk of breaking tabs 41 (see FIG. 1), and reduces the overall depth and/or size of the washing machine.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
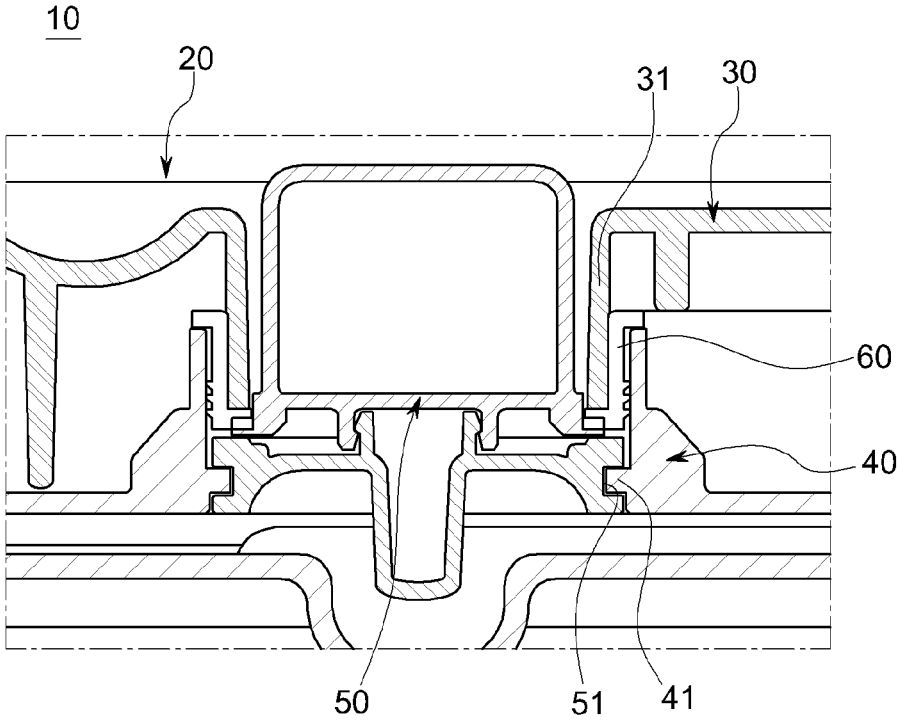
FIG. 1 is a cross-sectional view illustrating a washing machine according to the related art.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

In the present specification, it should be noted that in giving reference numerals to elements of each drawing, like reference numerals refer to like elements, even though like elements are shown in different drawings.

Meanwhile, meanings of the terms described in the present specification should be understood as follows.

It should be appreciated that the singular forms of terms also include the plural forms unless the context clearly defines otherwise, and the terms "first", "second", and the like are used to differentiate one constituent element from another constituent element, but the scope of the present disclosure should not be limited by these terms.

It should be appreciated that the terms "including", "having", or the like do not exclude the possibility of the existence or addition of one or more other specific characteristics, numbers, steps, operations, constituent elements, and components, or a combination thereof.

It should be appreciated that the term "at least one" includes all the combinations that can be presented from one or more associated items. For example, "at least one of a first item, a second item, and a third item" includes all the combinations of the items, which can be presented from two or more of the first item, the second item, and the third item, as well as each of the first item, the second item, and the third item.

In addition, the size and thickness of each component illustrated in the drawings may be shown arbitrarily for understanding and ease of description, but the present disclosure is not limited thereto. Thicknesses of several portions and regions may be enlarged for clear expressions.

Hereinafter, one or more exemplary embodiments of a washing machine according to the present disclosure will be described in detail with reference to the accompanying drawings.

Figure 2:
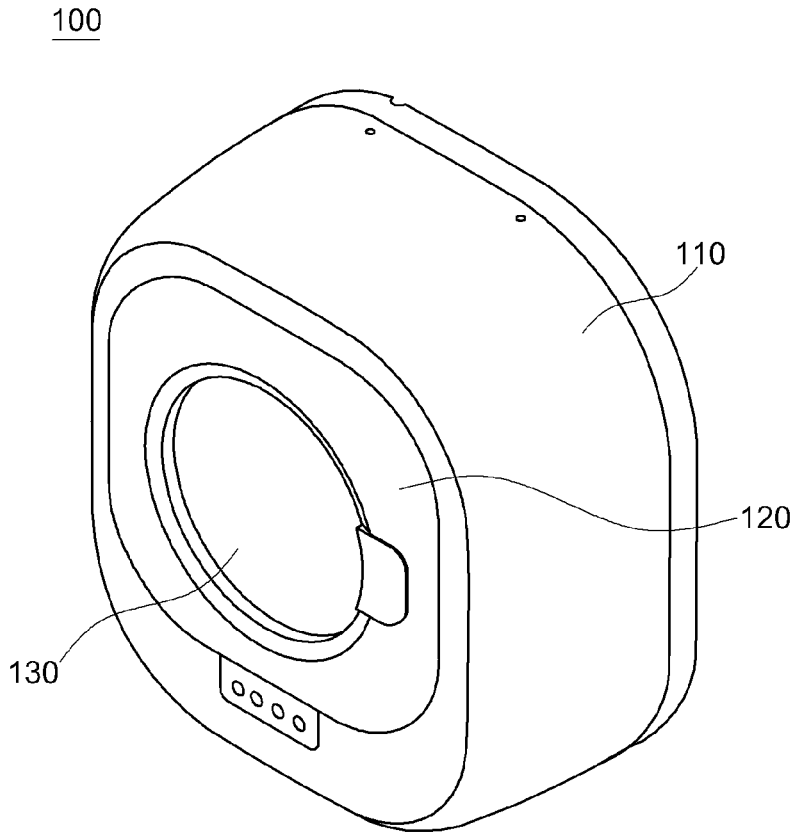
FIG. 2 is a view illustrating an exemplary washing machine according to embodiments of the present disclosure.
Figure 3:
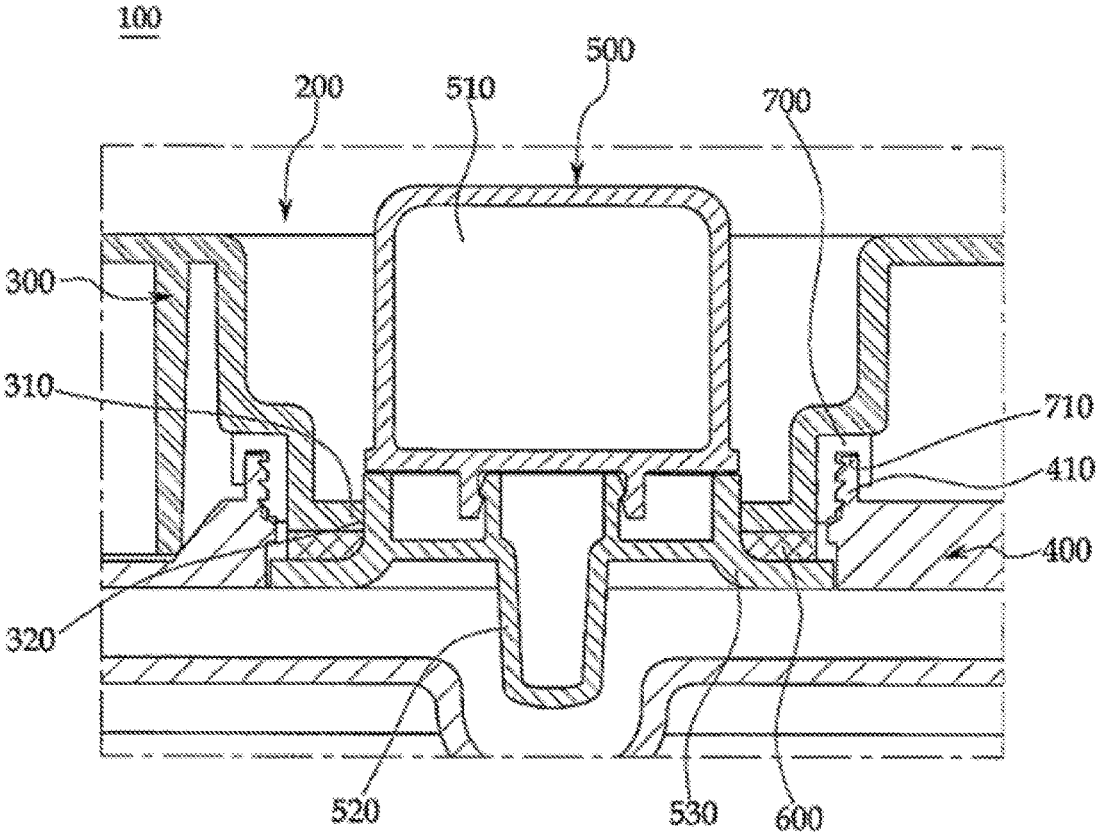
FIGS. 3 and 4 are cross-sectional views illustrating exemplary parts of an exemplary washing machine according to embodiments of the present disclosure.
Figure 4:
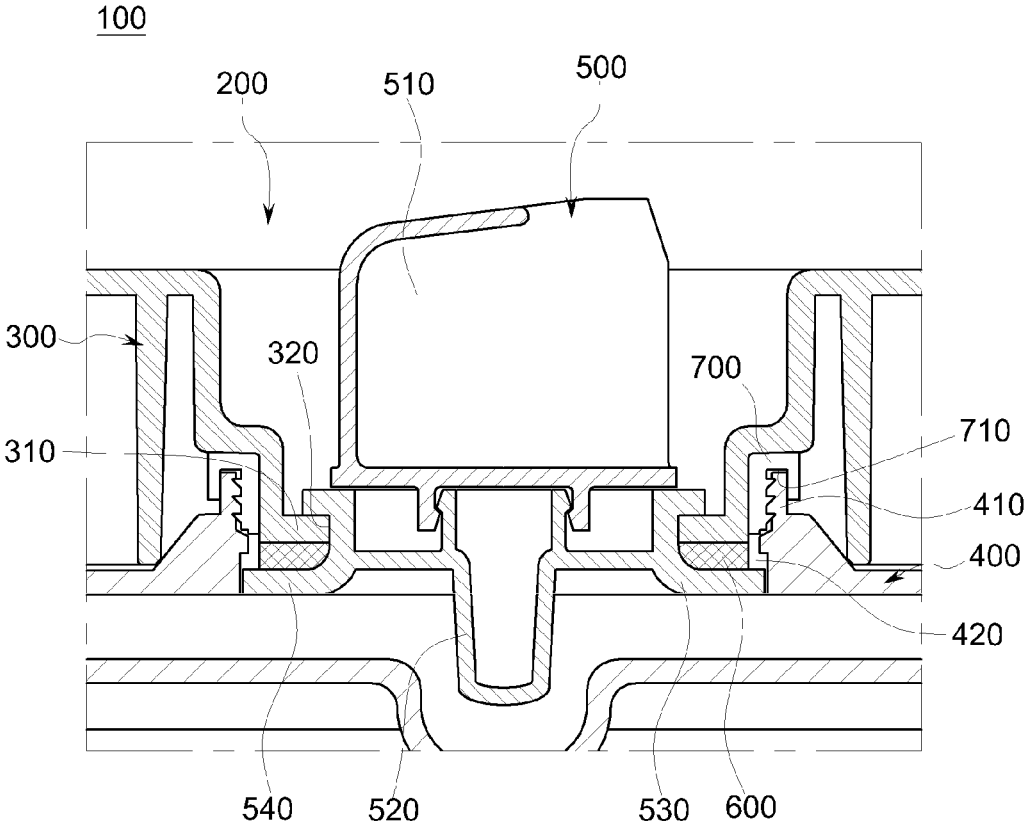

Referring to FIGS. 2 to 4, the washing machine 100 includes a tub main body 200 which holds water, a tub cover 300 which coupled to the tub main body 200 to cover a front side of the tub main body 200, a front panel 400 which on a front side of the tub cover 300 covering the tub cover 300, a detachable detergent container, dispenser, or case 500 extending into and/or over the tub main body 200, penetrating the front panel 400 and the tub cover 300, and coupled to the tub cover 300, and a first seal 600 which between the detergent container, dispenser, or case 500 and the tub cover 300 to seal the tub main body 200.

The detergent container, dispenser, or case 500 is detachably coupled to the tub cover 300. The detergent container, dispenser, or case 500 includes a first extension or flange 530 and an optional second extension or flange 540. The first extension or flange 530 and the second extension or flange 540 are separated by a predetermined distance. The tub cover 300 includes a fixing projection 310 between the first extension or flange 530 and the second extension or flange 540. In one embodiment (see FIG. 4), the fixing projection 310 is inserted between the first extension or flange 530 and the second extension or flange 540 such that the detergent container, dispenser, or case 500 is coupled to the tub cover 300 and may be detached.

The first seal 600 is coupled to the first extension or flange 530 to seal the tub main body 200. The first seal 600 is coupled to the first extension or flange 530 between the detergent container, dispenser, or case 500 and the tub cover 300. The first seal 600 is coupled to the first extension or flange 530 and stays in contact with the fixing projection 310. The fixing projection 310 and the first seal 600 are between the first extension or flange 530 and the second extension or flange 540. The fixing projection 310 and the first seal 600, which are between the first extension or flange 530 and the second extension or flange 540, are kept in contact with each other by the first extension or flange 530 and the second extension or flange 540. The first seal 600 and the fixing projection 310 stay in contact with each other so that flat surfaces thereof come into contact with each other.

Therefore, the exemplary washing machine 100 according to the present disclosure may achieve the following effects.

First, according to embodiments of the present disclosure, the flat surfaces of the first seal 600 and the fixing projection 310 of washing machine 10 maintain contact with each other to seal the tub main body 200. When the flat surfaces of the first seal 600 and the fixing projection 310 come into contact with each other, the first seal 600 and the fixing projection 310 may maintain contact with each other despite potential misalignment of the seal 600, the front cover 400, and/or tub cover 300. Therefore, the first seal 600 and the fixing projection 310 may maintain contact with each other so to seal the tub main body 200.

Accordingly, according to embodiments of the present disclosure, the washing machine 100 may prevent water in the tub main body 200 from leaking outside of the tub main body 200.

Second, according to embodiments of the present disclosure, because the first seal 600 and the fixing projection 310 come into contact with each other between the first extension or flange 530 and the second extension or flange 540, the first seal 600 and the fixing projection 310 may be prevented from separating from each other. Furthermore, a separation distance between the first radial extension or flange 530 and the second extension or flange 540 is equal to or slightly smaller than the sum of a width of the first seal 600 and a width of the fixing projection 310. Thus, the first extension or flange 530 and the second extension or flange 540 may press together the first seal 600 and the fixing projection 310. That is, the first seal 600 and the fixing projection 310 are pressed together by the first extension or flange 530 and the second extension or flange 540 such that the first seal 600 and the fixing projection 310 come into closer contact with each other. As such, according to embodiments of the present disclosure, the close contact between the first seal 600 and the fixing projection 310 is securely maintained, such that the tub main body 200 may be more perfectly sealed.

According to embodiments of the present disclosure, the detergent container, dispenser, or case 500 may be directly coupled to the tub cover 300. Specifically, the fixing projection 310 may be between the first extension or flange 530 and the second extension or flange 540 such that the detergent container, dispenser, or case 500 may be coupled to the tub cover 300, rather than to the frontpanel 400. As such, the detergent container, dispenser, or case 500 is coupled to a structure that is adjacent or closest to the tub main body 200, thereby minimizing the degree to which the detergent container, dispenser, or case 500 protrudes or extends in front of the washing machine 100. As a result, the thickness or depth of the washing machine 100 may be reduced or minimized, and the washing machine 100 may be miniaturized.

Hereinafter, the tub main body 200, the tub cover 300, the front panel 400, the detergent container, dispenser, or case 500, and the first seal 600 will be described in detail with reference to the accompanying drawings.

Referring to FIGS. 2 to 4, the tub main body 200 holds water. The tub main body 200 and the tub cover 300 are coupled such that an enclosed tub is formed. The water is held in the enclosed tub.

The tub is inside a cabinet 110 and formed by coupling the tub main body 200 and the tub cover 300. A front side of the cabinet 110 may have an opening and/or entrance 130 therein. A user may put the laundry into the washing machine 100 according to embodiments of the present disclosure through the entrance or opening 130. The door 120 is coupled to the front side of the cabinet 110 so that the entrance or opening of the cabinet 110 may be opened and closed by the door 120.

The tub main body 200 may have an approximately cylindrical shape. Thus, the tub main body 200 may have a cylindrical or slightly conical shape, and an opening in a front side thereof. The tub cover 300 may be placed on/coupled to the tub main body 200. A drum (not illustrated) may be inside the tub main body 200 and may rotate therein. The rotatable drum may hold laundry and the like. The drum may lift up and drop the laundry while rotating by drive power supplied from a power source, and therefore, contaminants are separated or removed from the laundry, and the laundry is washed.

Referring to FIGS. 2 to 4, the tub cover 300 is coupled to a front or open side of the tub main body 200. The tub cover 300 is coupled to the tub main body 200 to cover the front of the tub main body 200.

The tub cover 300 has a first insertion hole or opening 320, and the detergent container, dispenser, or case 500 may be inserted into the first insertion hole or opening 320. The detergent container, dispenser, or case 500 may penetrate the tub cover 300 through the first insertion hole or opening 320, and protrude or extend toward the interior of the tub main body 200.

The tub cover 300 has a fixing projection 310 that couples with the detergent container, dispenser, or case 500. The fixing projection 310 is inserted between the first extension or flange 530 and the second extension or flange 540 to couple the detergent container, dispenser, or case 500 and the tub cover 300. The fixing projection 310 is in the first insertion hole or opening 320 hole or opening and protrudes or extends toward a center of the first insertion hole or opening 320. The fixing projection 310 may be parallel with the tub cover 300 and/or the front panel 400.

A plurality of fixing projections 310 may be on or around the first insertion hole or opening 320. The fixing projections 310 may be spaced apart from each other. The fixing projection 310 may have a shape similar to a type of gear (e.g., a slightly spiral shape).

Referring to FIGS. 2 to 4, according to embodiments of the present disclosure, the front panel 400 may be in front of the tub cover 300. Various types of buttons and a display device, which allow the user to control the washing machine 100, may be installed on and/or behind the front panel 400.

The front panel 400 may have a second insertion hole or opening 420 into which the detergent container, dispenser, or case 500 may be inserted. The second insertion hole or opening 420 is at a position that corresponds to a position of the first insertion hole or opening 320. The detergent container, dispenser, or case 500 may penetrate the front panel 400 through the second insertion hole or opening 420. The detergent container, dispenser, or case 500 may completely extend through the tub cover 300 through the first insertion hole or opening 320 and the second insertion hole or opening 420, and may protrude or extend toward the interior of the tub main body 200.

The front panel 400 may have a sealing projection 410 that extends or protrudes toward the interior of the tub main body 200. The sealing projection 410 may be in an interior part of or around the second insertion hole or opening 420 (e.g., an inner surface of and/or a part/portion of the hole 420 towards the tub main body 200). The sealing projection 410 may be next to the second insertion hole or opening 420.

Referring to FIGS. 2 to 4, the washing machine 100, according to embodiments of the present disclosure, may have a second seal 700 coupled to the sealing projection 410. The second seal 700 may be between the front panel 400 and the tub cover 300. The second seal 700 may also be between the front panel 400 and the fixing projection 310. The second seal 700 may further be between the second insertion hole or opening 420 and the tub cover 300. The seals may comprise a compressible material, such as rubber (e.g., silicon, latex, natural rubber, etc.).

The second seal 700 seals the tub main body 200 together with the first seal 600. The tub main body 200 may be sealed more perfectly using two sealing members (e.g., the first seal 600 and the second seal 700). The washing machine 100, according to embodiments of the present disclosure, may more perfectly block water from leaking to the outside of the tub main body 200.

The second seal 700 may be coupled with the sealing projection 410. The second seal 700 may have a sealing groove or ring 710 coupled with the sealing projection 410. The sealing projection may be inserted into the sealing groove 710 such that the second seal 700 and the front panel 400 couple to each other. The second seal 700 may be coupled to the front panel 400 such that the second seal 700 fully contacts the front panel 400 through the sealing 710, thereby more securely sealing the tub main body 200.

Referring to FIGS. 2 to 4, the detergent container, dispenser, or case 500 may be detachably coupled to the tub cover 300. The detergent container, dispenser, or case 500 may extend into the tub main body 200 detergent container, dispenser, or case and dispense and/or supply detergent, which is mixed with the water to the tub main body 200.

The detergent container, dispenser, or case 500 may have a detergent holder 510 that holds the detergent, a handle 520 that extends or connects to the detergent holding portion 510 and protrudes toward the front of the washing machine 100, and a first extension or flange 530 and a second extension or flange 540 that extend from the handle 520 to fix the handle 520 to the tub cover 300.

The detergent holder 510 comprises an open cup or container that protrudes or extends toward the interior of the tub main body 200 when the detergent container, dispenser, or case 500 is coupled to the tub cover 300. The detergent holding portion 510 holds the detergent, and supplies the detergent to the tub main body 200 when water from the water supply pipe flows into the detergent holder 510 (e.g., by overflowing into the tub, or through a hole in the back/bottom surface of the holder 510).

The handle 520 extends toward the front of the front panel 400. The handle 520 is coupled to the detergent holder 510. The user may couple the detergent container, dispenser, or case 500 to the tub cover 300 or separate the detergent container, dispenser, or case 500 from the tub cover 300 by manipulating and/or rotating the handle 520. The user may grip the handle 520, and then insert the detergent container, dispenser, or case 500 into the first insertion hole or opening 320 and/or the second insertion hole or opening 420, or remove the detergent container, dispenser, or case 500 from the first insertion hole or opening 320 and/or the second insertion hole or opening 420. The user may couple the first extension or flange 530 and the second extension or flange 540 with the fixing projection 310, and separate the first extension or flange 530 and the second extension or flange 540 from the fixing projection 310, by rotating the handle 520.

The first extension or flange 530 and the second extension or flange 540 extend or protrude from the handle 520. The first extension or flange 530 and the second extension or flange 540 extend or to protrude radially from the handle 520.

The first extension or flange 530 and the second extension or flange 540 may be spaced apart from each other by a predetermined distance. The distance between the first extension or flange 530 and the second extension or flange 540 may be equal to or smaller than the sum of the width or thickness of the fixing projection 310 and the width or thickness of the first seal 600.

The first extension or flange 530 and the second extension or flange 540 may be parallel with each other. The first extension or flange 530 may be towards the front side of the washing machine 100, and the second extension or flange 540 may be towards the rear. The first extension or flange 530 may be adjacent to the front panel 400, and the second extension or flange 540 may be adjacent to and/or inside the tub cover 300 (e.g., towards the tub main body 200).

The first extension or flange 530 may be on and/or around the handle 520. The first extension or flange 530 may cover the area around the handle 520. In one embodiment, the first ring or extension 530 further includes a mechanism (e.g., a tab or slot) configured to mate with and/or couple to a corresponding mechanism in the tub cover projection 310 (e.g., exposed through the seal 600), in the absence of a second ring or extension 540.

A plurality of second protruding portions 540 may be on and/or around the handle 520. The second protruding portions 540 may be spaced apart from each other. The second extension or flange 540 may have a shape similar to a type of gear (e.g., a slightly spiral shape). The fixing projection 310 may also have a shape similar to a gear (e.g., a slightly spiral shape). Therefore, when the second extension or flange 540 and the fixing projection 310 are at aligned/corresponding positions extension or flange, the detergent container, dispenser, or case 500 and the tub cover 300 can be coupled with each other. In contrast, when the second extension or flange 540 and the fixing projection 310 are not at aligned/corresponding positions, but are positioned in a staggered/unaligned arrangement, the detergent container, dispenser, or case 500 and the tub cover 300 may be separate from each other.

Referring to FIGS. 2 to 4, the first seal 600 may be between the detergent container, dispenser, or case 500 and the tub cover 300. The first seal 600 may be between the first extension or flange 530 and the fixing projection 310. The first seal 600 may contact the first extension or flange 530 between the first extension or flange 530 and the fixing projection 310. The first seal 600 may extendalong the entire first extension or flange 530. The first seal 600 may contact or be coupled to the first extension or flange 530 such that the seal 600 is on and/or around the protruding portion 530.

The first seal 600 may be on and/or around the first extension or flange 530, such that flat surfaces of the first seal 600 and the fixing projection 310 come into contact with each other. A flat surface of the first seal 600 comes into close contact with an entire flat surface of a front side of the fixing projection 310. That is, the first seal 600 securely contacts the fixing projection 310.

The first seal 600 may comprise an elastic material that may more perfectly contact the fixing projection 310, between the first extension or flange 530 and the second extension or flange 540. The fixing projection 310 and the first seal 600 may be between the first extension or flange 530 and the second extension or flange 540, and come into complete contact with each other. Furthermore, the fixing projection 310 and the first seal 600 may be between the first extension or flange 530 and the second extension or flange 540 to prevent separation from each other.

Since the distance between the first extension or flange 530 and the second extension or flange 540 may be equal to or smaller than the sum of the width or thickness of the fixing projection 310 and the width or thickness of the first seal 600, the fixing projection 310 and the first seal 600 may be pressed against each other when the fixing projection 310 and the first seal 600 are between the first extension or flange 530 and the second extension or flange 540. Therefore, the fixing projection 310 and the first seal 600 come into closer and/or more complete contact with each other. Accordingly, the first seal 600 may securely seal the tub main body 200.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

a tub main body that holds water;

a tub cover that is coupled to the tub main body and configured to cover a front of the tub main body, wherein the tub cover includes a first insertion hole or opening and a fixing projection which protrudes or extends toward a center of the first insertion hole or opening;

a front panel configured to cover a front of the tub cover;

a detergent container, dispenser, or case detachably inserted into the first insertion hole or opening and configured to extend through the front panel and the tub cover, and into the tub main body, wherein the detergent container, dispenser, or case comprises a detergent holding portion which holds detergent;

a handle connected to the detergent holding portion that faces toward a front of the washing machine;

a first extension or flange which extends or protrudes outward radially from the handle to fix the handle to the tub cover; and a first seal between the first extension or flange and the fixing projection, wherein the first seal is in contact with the first extension or flange and contacts a front surface of the fixing projection, and wherein the first seal is configured to seal the tub main body.

2. The washing machine of claim 1, wherein the detergent container, dispenser, or case further comprises:

a second extension or flange which extends or protrude from the handle to fix the handle to the tub cover.

3. The washing machine of claim 1, further comprising: a second seal between the front panel and the tub cover, configured to seal the tub main body.

4. The washing machine of claim 3, wherein the front panel comprises a sealing projection that extends toward the tub main body, and the second seal has a sealing groove or ring configured to receive the sealing projection.

5. The washing machine of claim 2, wherein the first extension or flange and the second extension or flange extend radially outward.

6. The washing machine of claim 1, wherein the detergent container, dispenser, or case may be removed from the tub cover by rotating the detergent container, dispenser, or case.

* * * * *